US009912038B2

(12) United States Patent
Armas et al.

(10) Patent No.: US 9,912,038 B2
(45) Date of Patent: Mar. 6, 2018

(54) PIT LID ANTENNA AND CASING

(71) Applicant: Mueller International, LLC, Atlanta, GA (US)

(72) Inventors: Rolando Armas, Ocala, FL (US); Martin Cole, Ocala, FL (US); John David Scherschel, Ocala, FL (US); Jorge Isaac Ortiz, Ocala, FL (US)

(73) Assignee: Mueller International, LLC, Atlanta, GA (US)

( * ) Notice: Subject to any disclaimer, the term of this patent is extended or adjusted under 35 U.S.C. 154(b) by 245 days.

(21) Appl. No.: 14/341,211

(22) Filed: Jul. 25, 2014

(65) Prior Publication Data

US 2016/0028149 A1 Jan. 28, 2016

(51) Int. Cl.
*H01Q 1/22* (2006.01)
*H01Q 21/06* (2006.01)

(52) U.S. Cl.
CPC ..... *H01Q 1/2233* (2013.01); *H01Q 21/064* (2013.01)

(58) Field of Classification Search
CPC ..... H01Q 1/2233
See application file for complete search history.

(56) References Cited

U.S. PATENT DOCUMENTS 5,298,894 A 3/1994 Cerny et al.
5,659,300 A 8/1997 Dresselhuys et al.
5,825,303 A 10/1998 Bloss, Jr. et al.
5,877,703 A 3/1999 Bloss et al.
6,014,113 A * 1/2000 Orchard ..... H01Q 1/40 343/702
6,177,883 B1 1/2001 Jennetti et al.
6,218,995 B1 4/2001 Higgins et al.
6,300,907 B1 10/2001 Lazar et al.
6,304,227 B1 10/2001 Hill et al.
6,369,769 B1 4/2002 Nap et al.
6,378,817 B1 4/2002 Bublitz et al.
6,414,605 B1 7/2002 Walden et al.
6,606,070 B2 8/2003 Olson et al.
6,617,976 B2 9/2003 Walden et al.
6,657,552 B2 12/2003 Belski et al.
6,819,292 B2 11/2004 Winter
6,954,144 B1 10/2005 Kiser et al.
7,202,828 B2 4/2007 Zehngut et al.
7,221,286 B2 5/2007 Gould et al.
7,283,063 B2 10/2007 Salser, Jr.
7,365,687 B2 4/2008 Borleske et al.
7,446,672 B2 11/2008 Johnson et al.
7,453,373 B2 11/2008 Cumeralto et al.
7,508,318 B2 3/2009 Casella et al.
7,510,422 B2 3/2009 Showcatally et al.
7,554,460 B2 6/2009 Verkleeren et al.
7,683,261 B2 * 3/2010 Kesler ..... H05K 5/069 174/50.57
7,746,246 B2 6/2010 Salser
8,378,847 B2 2/2013 Bartram et al.
(Continued)

*Primary Examiner* — Daniel J Munoz
(74) *Attorney, Agent, or Firm* — Taylor English Duma LLP

(57) ABSTRACT

Disclosed is a pit lid antenna assembly including an antenna having an upper section and a lower section; and an antenna casing having a casing wall having an inner surface, the inner surface defining a first antenna slot, the first antenna slot sized to accept a portion of the lower section of the antenna.

24 Claims, 18 Drawing Sheets

(56) References Cited

U.S. PATENT DOCUMENTS

| | | | | |
|---|---|---|---|---|
| 2005/0285807 | A1* | 12/2005 | Zehngut | H01Q 1/04 343/719 |
| 2007/0120755 | A1* | 5/2007 | Blickle | H01Q 1/1214 343/713 |
| 2008/0272981 | A1 | 11/2008 | Gagne et al. | |
| 2010/0026515 | A1 | 2/2010 | Lazar et al. | |
| 2010/0182162 | A1 | 7/2010 | Winkler et al. | |
| 2011/0062298 | A1* | 3/2011 | Bartram | G01D 4/002 248/222.14 |
| 2011/0063124 | A1 | 3/2011 | Bartram et al. | |

* cited by examiner

PIT LID ANTENNA AND CASING

TECHNICAL FIELD

This disclosure relates to antennas. More specifically, this disclosure relates to antennas and antenna casings for utility meter pit lids.

BACKGROUND

Utility meters such as residential water meters may be placed underground in a meter box. Some meter boxes include metal lids and metal bodies. Utility meters may include wireless communication capability to send and receive wireless communications with a remote communication device, enabling remote reading of meters, such as in an automatic meter reading or advanced meter infrastructure (AMR/AMI) system. However, wireless transmissions from utility meters with wireless capability are blocked by the lids and bodies of meter boxes, especially metal lids, making communication between the meter and the remote communication device difficult.

SUMMARY

Disclosed is a pit lid antenna assembly including an antenna having an upper section and a lower section; and an antenna casing having a casing wall having an inner surface, the inner surface defining a first antenna slot, the first antenna slot sized to accept a portion of the lower section of the antenna.

Also disclosed is a pit lid antenna assembly including an antenna; and an antenna casing housing the antenna and having a casing wall defining a connection hole; and an adapter casing attached to the antenna casing and including a locking tab, the locking tab having a plug sized to fit within the connection hole to attach the adapter casing to the antenna casing.

Also disclosed is a method of installing an antenna assembly in a meter pit including mounting an antenna casing onto a pit lid, the antenna casing housing an antenna and including a casing wall, the casing wall extending below the pit lid and defining a connection hole; attaching a radio unit to adapter casing, the adapter casing including a locking tab having a plug; attaching the adapter casing to the antenna casing by snapping the plug of the locking tab into the connection hole.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a pit lid antenna assembly and associated methods, systems, devices, and various apparatus. The antenna assembly includes antenna casing and an antenna housed within the antenna casing. It would be understood by one of skill in the art that the disclosed pit lid antenna assembly is described in but a few exemplary embodiments among many. No particular terminology or description should be considered limiting on the disclosure or the scope of any claims issuing therefrom.

Figure 1:
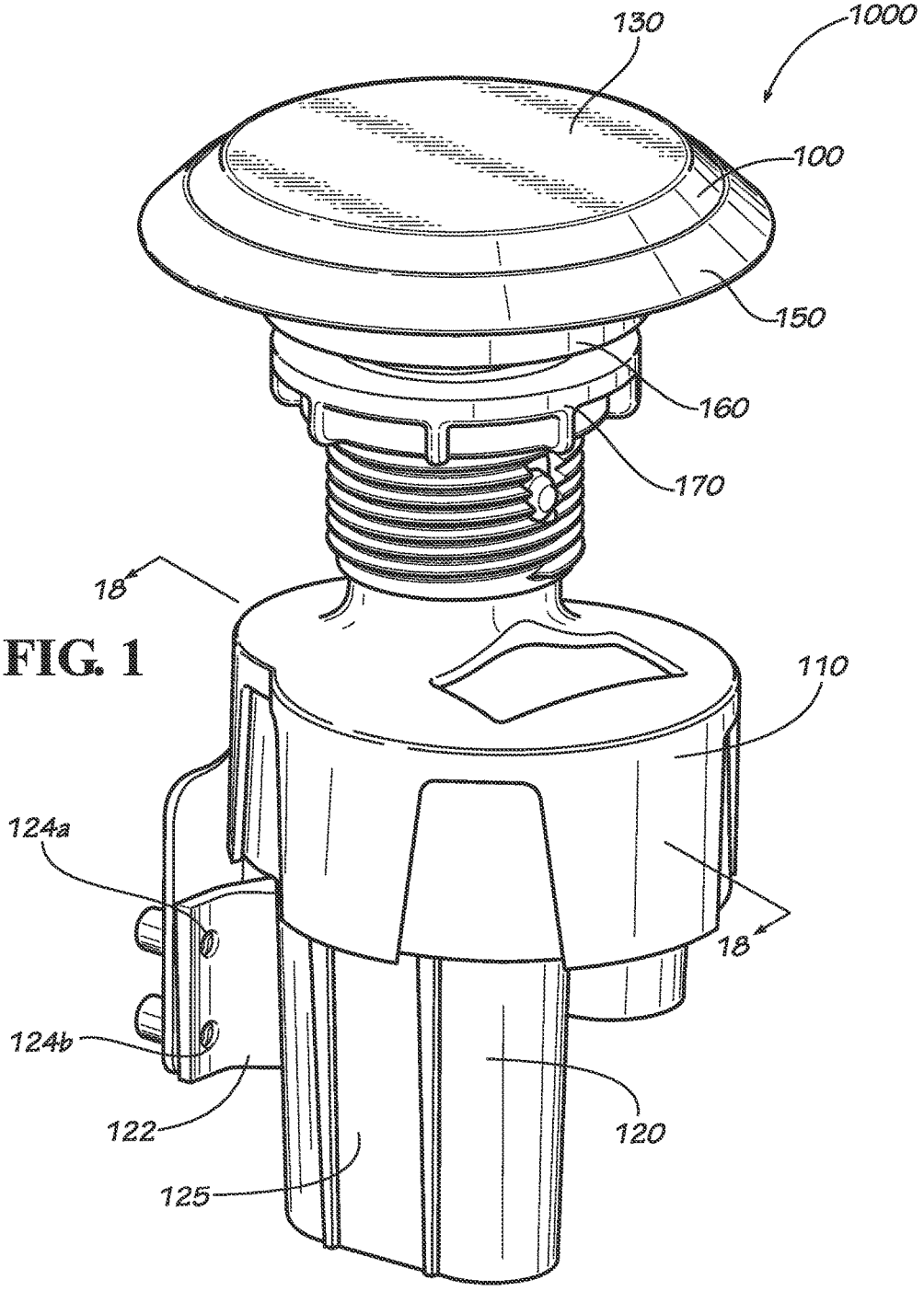
FIG. 1 is a perspective view of a pit lid antenna assembly in accordance with one embodiment of the current disclosure.

One embodiment of a pit lid antenna assembly 1000 is disclosed and described in FIG. 1.

The antenna assembly 1000 includes an antenna casing 100, an adapter casing 110, a radio unit 120, a top cap 130, an upper washer 150, a lower washer 160, and a nut 170. The radio unit 120 includes radio housing 125 containing a radio antenna (not shown). The radio antenna is connectable to a utility meter, typically a water meter in a meter pit having a pit lid.

Figure 2:
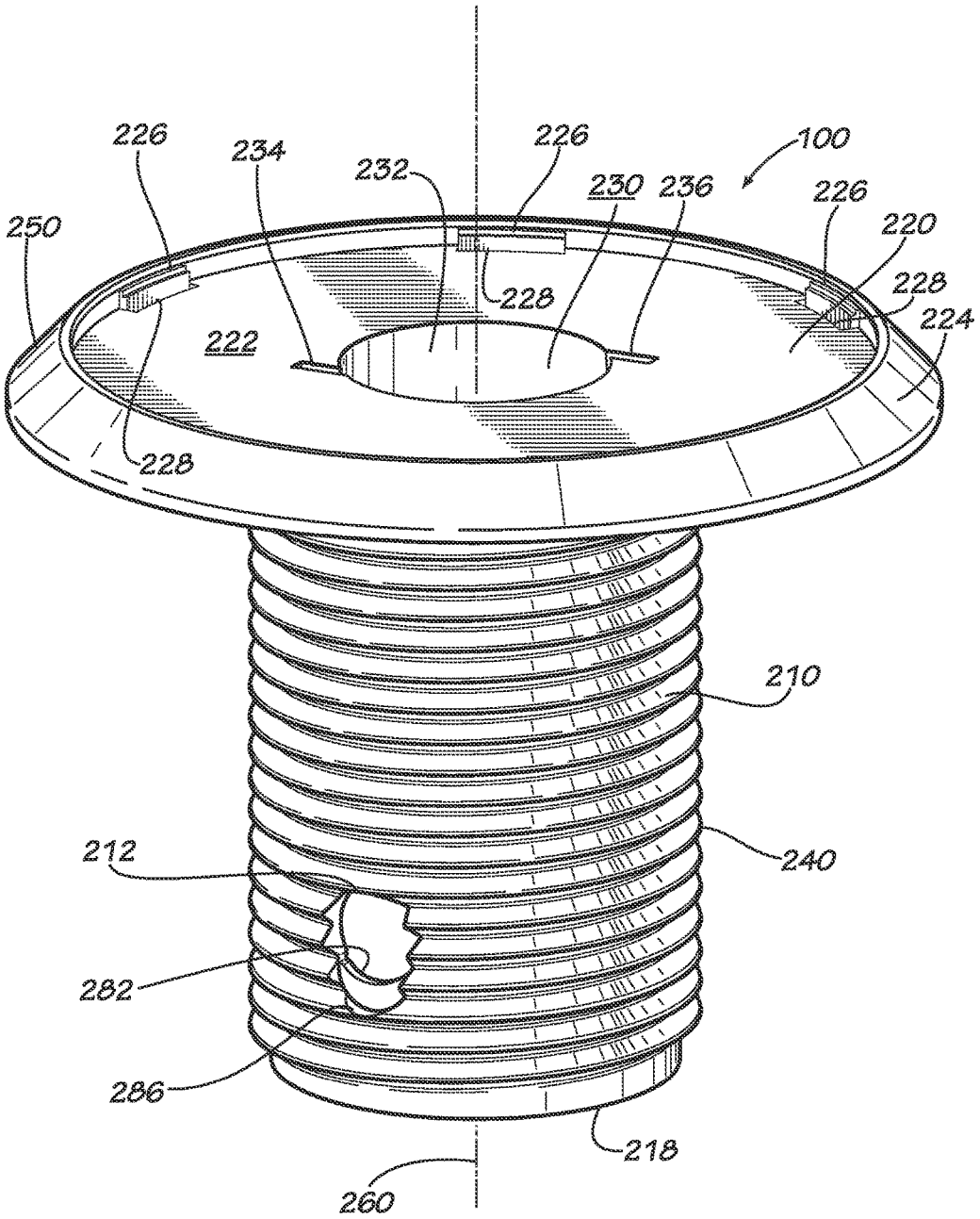
FIG. 2 is a perspective view of an antenna casing of the antenna assembly of FIG. 1.

FIG. 2 shows the antenna casing 100. As shown in FIG. 2, in the current embodiment the antenna casing 100 is a mushroom-type housing and includes a casing wall 210 and a mushroom head 220. In the current embodiment, the casing wall 210 is generally cylindrical-shaped, defining an axis 260, and extends from a bottom edge 218 to the mushroom head 220. The casing wall 210 includes an inner surface 230 defining an upper cylindrical section 232, a first antenna slot 234, and a second antenna slot 236. The inner surface 230 defines a cavity within the casing wall 210. In the current embodiment, the first antenna slot 234 and the second antenna slot 236 extend radially outward from the cylindrical section 232. The casing wall 210 also includes external threads 240 sized to engage internal threads 272 (shown in FIG. 16) of the nut 170. A first connection hole 212 and a second connection hole 214 (shown in FIG. 5) are defined in the casing wall 210 extending through the casing wall 210. The first connection hole 212 and the second connection hole 214 extend through the casing wall 210 from the external threads 240 to the inner surface 230. A first catch lip 282 is located in the casing wall 210 adjacent and axially below the first connection hole 212, and is defined by a first thread cutout 286 in the external threads 240. Likewise, a second catch lip 284 (shown in FIG. 5) is located in the casing wall 210 adjacent and axially below the second connection hole 214, and is defined by a second thread cutout 288 (shown in FIG. 5) in the external threads 240. The first thread cutout 286 and the second thread cutout 288 are semicircular in the current embodiment, though other shapes may be present in various embodiments.

Figure 3:
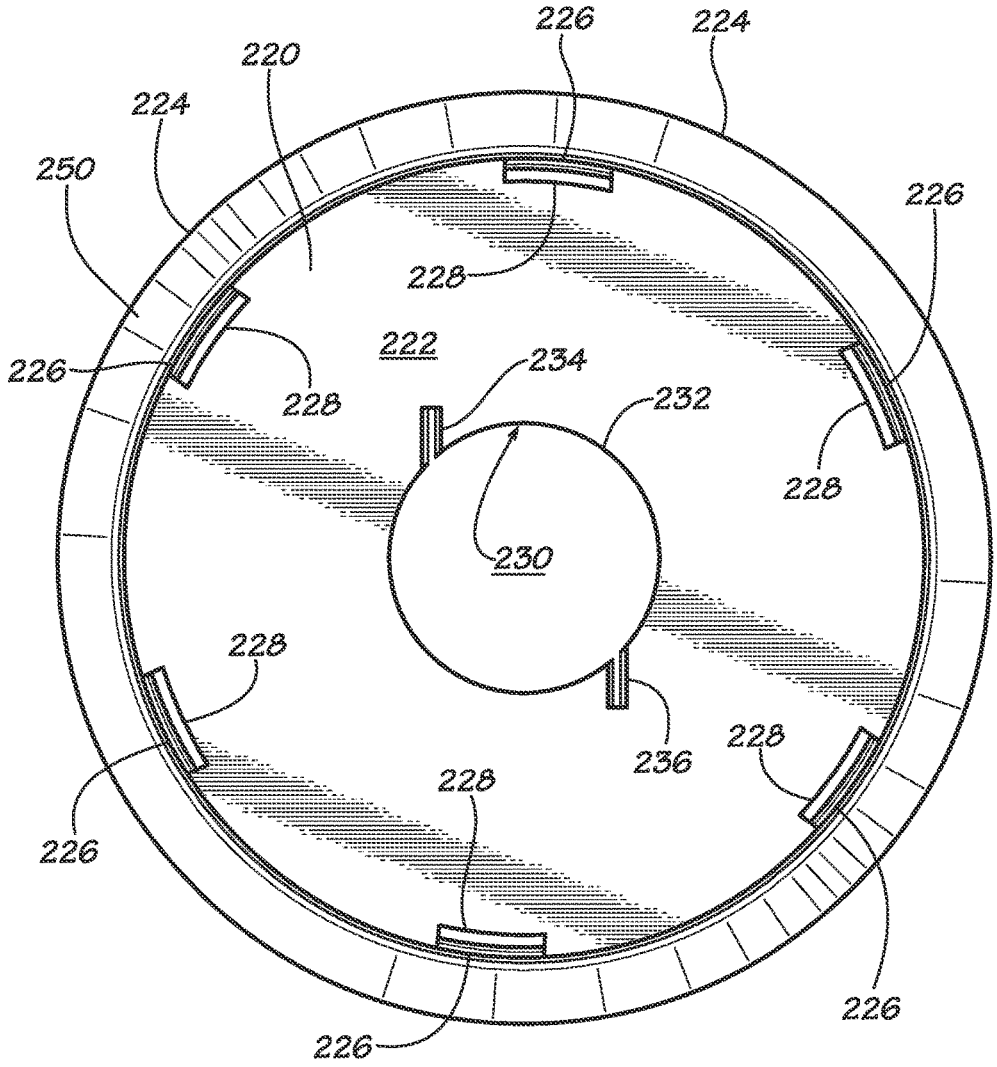
FIG. 3 is a top view of the antenna casing of FIG. 2.

As shown in FIG. 3, the mushroom head 220 includes a top surface 222, a rim 224, and a plurality of cap ledges 226 spaced around the periphery of the top surface 222. The top surface 222 intersects the inner surface 230, thereby defining cross-sections of the upper cylindrical section 232, the first antenna slot 234, and the second antenna slot 236. The top surface 222 also defines a plurality of cap connector slots 228 adjacent each cap ledge 226, each connector slot 228 sized to accept a connector tab (not shown) on the top cap 130 to attach the top cap 130 to the antenna casing 100. The rim 224 includes a chamfer 250.

Figure 4:
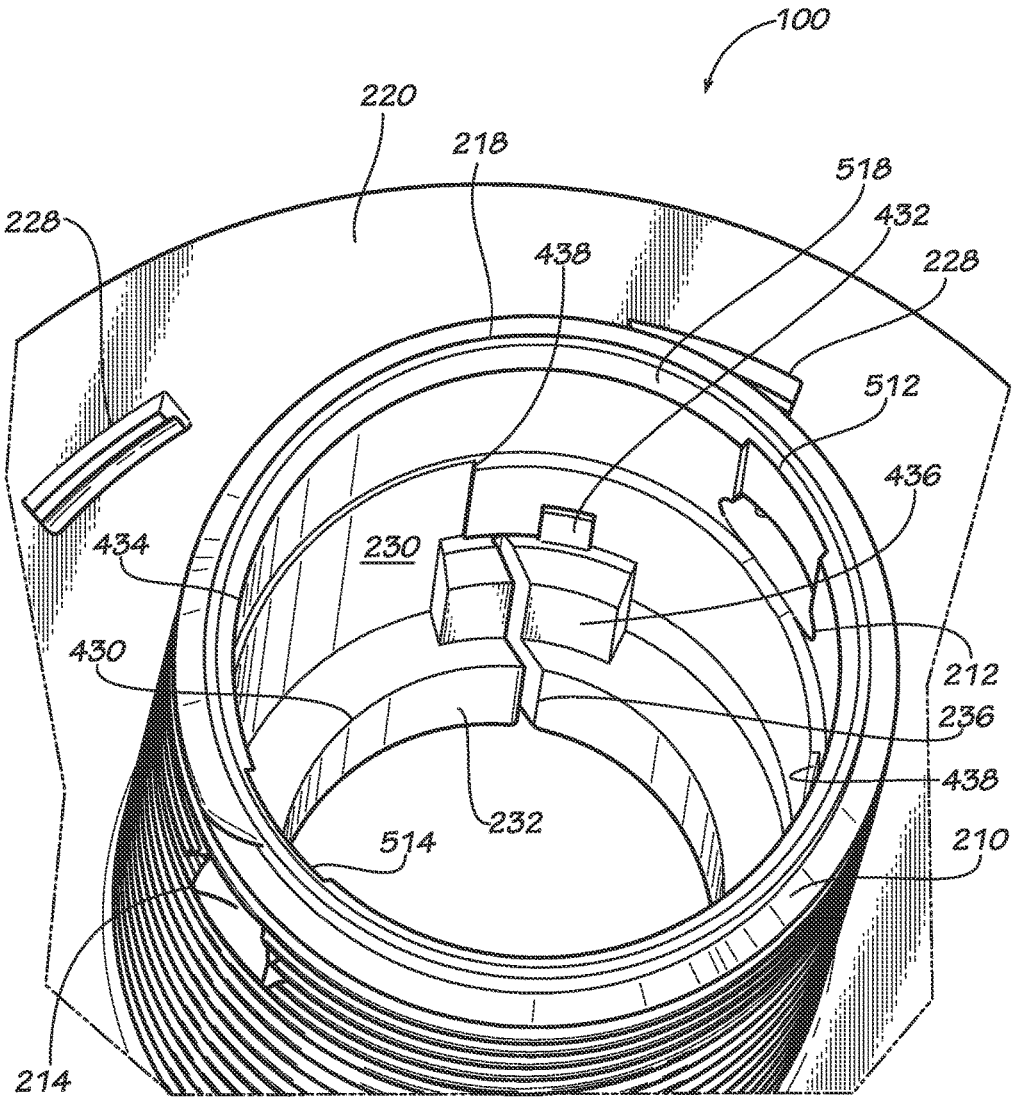
FIG. 4 is another perspective view of the antenna casing of FIG. 2 showing an interior of the antenna casing.

FIG. 4 shows a bottom perspective view of the antenna casing 100. As shown in FIG. 4, the inner surface 230 may define an upper circumferential shoulder 430. The upper circumferential shoulder 430 forms the upper cylindrical section 232. The inner surface 230 may also defines a first minor shoulder 486 (shown in FIG. 16) and a second minor shoulder 436 extending axially below the upper circumferential shoulder 430. The first antenna slot 234 extends through the first minor shoulder 486 and second antenna slot 236 extends through the second minor shoulder 436. In the current embodiment, the first antenna slot 234 defines a plane parallel to a plane defined by the second antenna slot 236. The first minor shoulder 486 and the second minor shoulder 436 are similar in shape in the current embodiment. A support tab 432 may extend axially below the second minor shoulder 436, and a similar support tab (not shown) may extend axially below the first minor shoulder 486. The inner surface 230 may also define a middle circumferential shoulder 434, which may include one or more shoulder steps 438.

Figure 5:
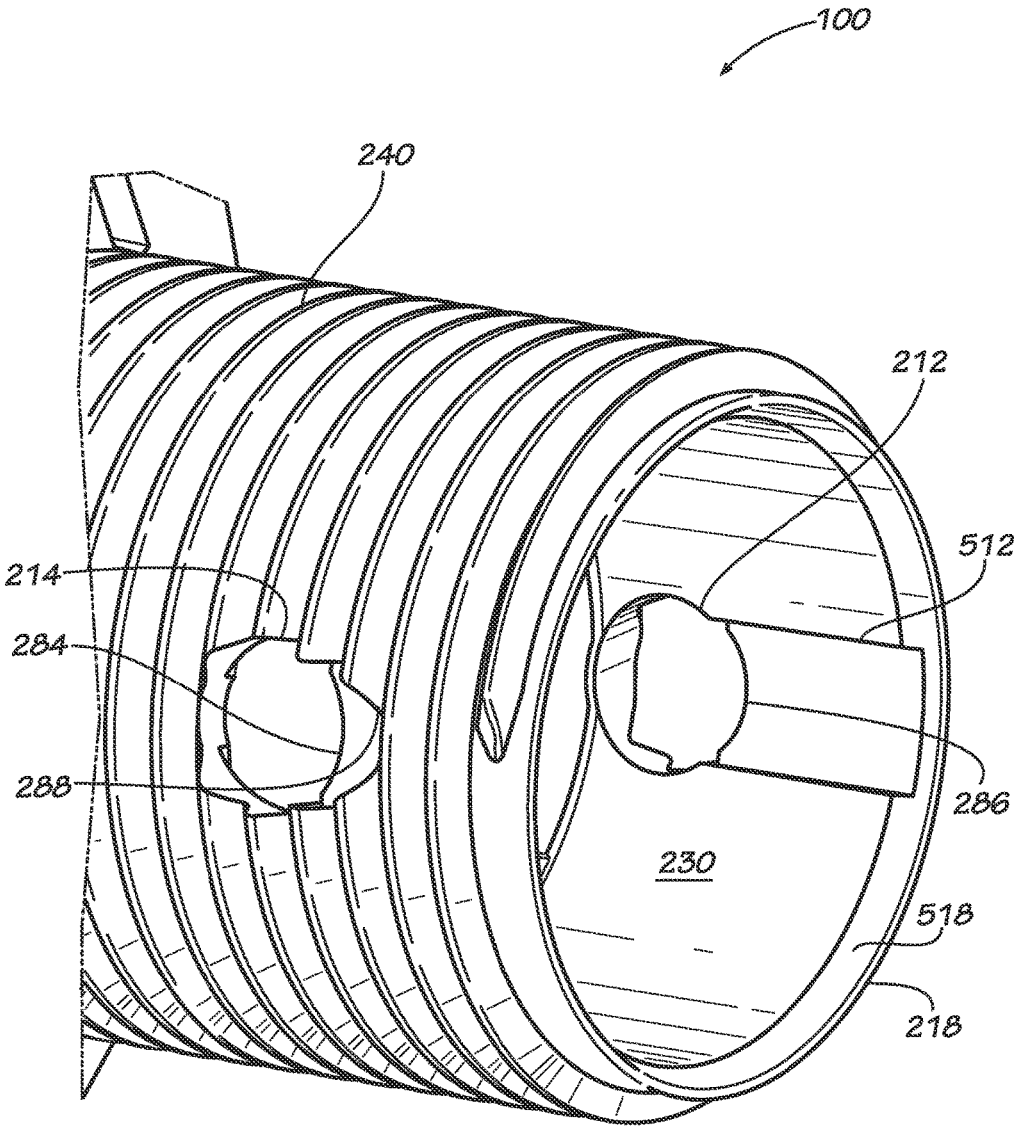
FIG. 5 is another perspective view of the antenna casing of FIG. 2 showing an interior of the antenna casing.

As shown in FIGS. 4 and 5, in the current embodiment, the inner surface 230 further defines a first guide slot 512 and a second guide slot 514. The first guide slot 512 extends from the first connection hole 212 to the bottom edge 218, which includes an inner chamfer 518. The second guide slot 514 extends from the second connection hole 214 to the bottom edge 218. In various embodiments, the first guide slot 512 and the second guide slot 514 may be defined in the external threads 240 rather than the inner surface 230.

Figure 6:
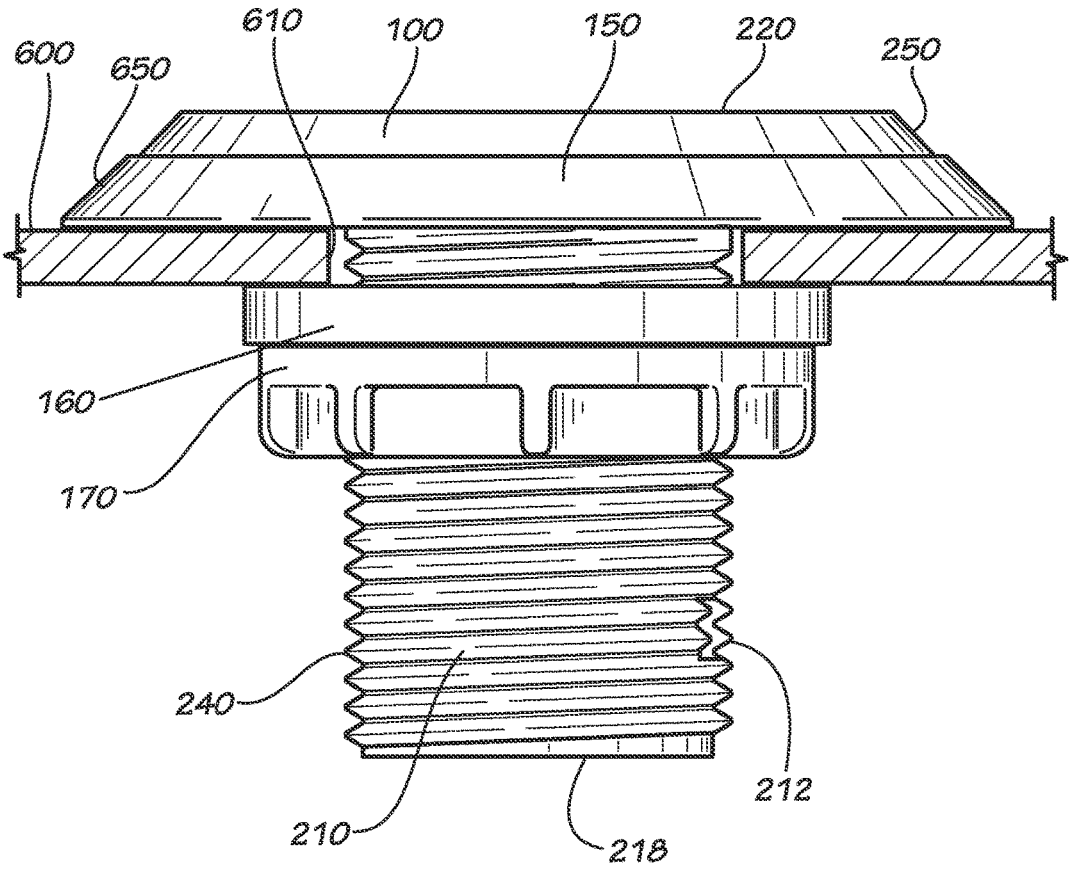
FIG. 6 is a side view of the antenna casing of FIG. 2 installed on a pit lid with an upper washer, lower washer, and nut of the antenna assembly of FIG. 1.

FIG. 6 shows the antenna casing 100 mounted on a pit lid 600, showing the pit lid 600 in cross-section. The pit lid 600 may be the lid of a meter pit such as a cast iron water meter pit placed along an underground residential or commercial water line, with the pit lid 600 providing access at ground level to the water meter placed within the meter pit. A mounting hole 610 is defined through the pit lid 600. The casing wall 210 of the antenna casing 100 is inserted through a hole defined in the upper washer 150, then through mounting hole 610 of the pit lid 600, and then through a hole defined in the lower washer 160. The nut 170 is then installed on the external threads 240 of the casing wall 210 and turned until the nut 170 tightly engages the lower washer 160, thereby tightly mounting the antenna casing 100 on the pit lid 600. As shown in FIG. 6, the mushroom head 220 rests on the upper washer 150. The upper washer 150 also includes a chamfer 650. The chamfer 650 of the upper washer 150 and the chamfer 250 of the mushroom head 220 provide the antenna casing 100 with a low profile to protect portion of the antenna assembly 1000, including the antenna 1100 (shown in FIG. 11) housed within the antenna casing 100, which extends above the pit lid 600, allowing wheeled devices such as automobiles or lawnmowers to pass more easily over the antenna assembly 1000.

Figure 7:
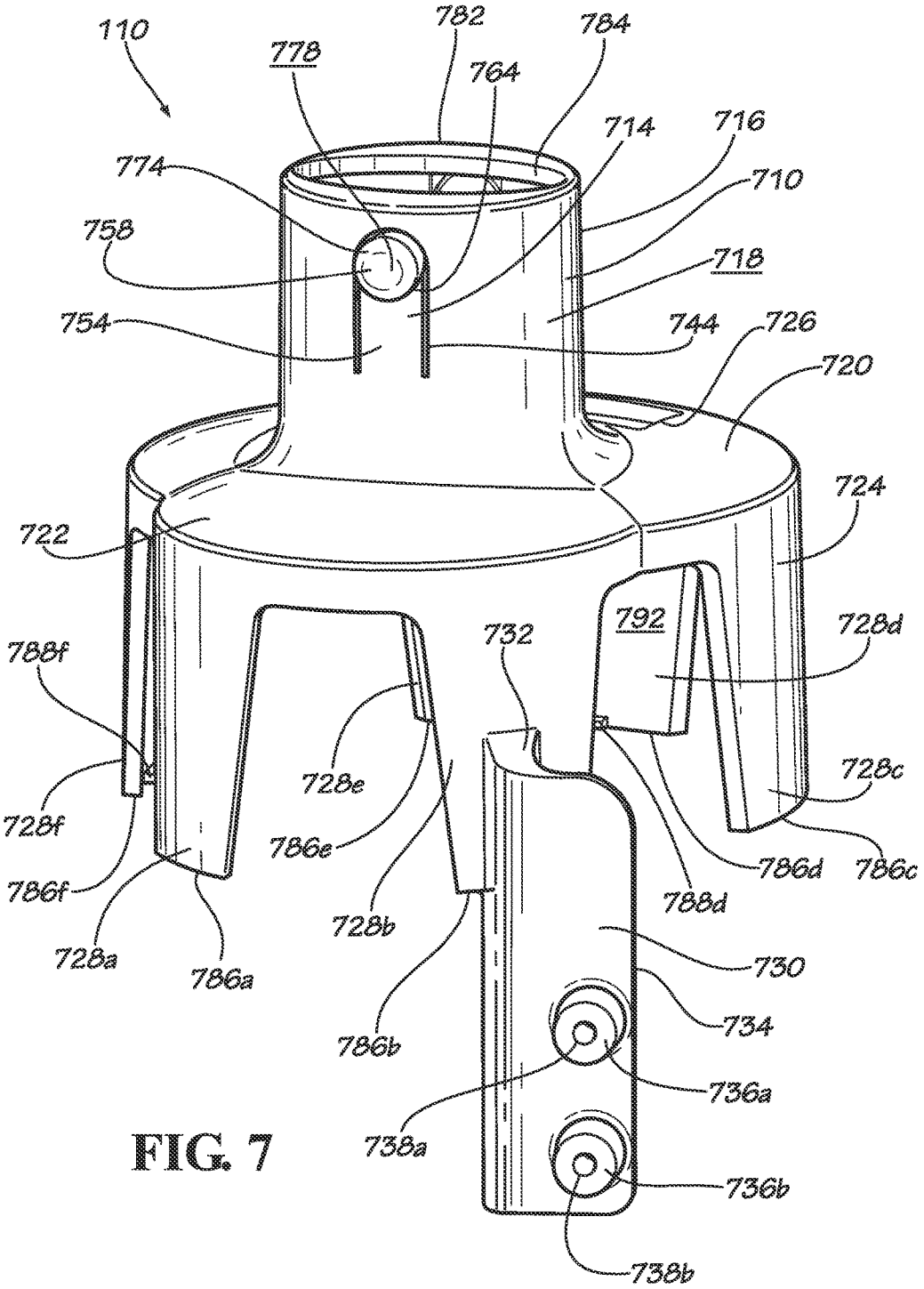
FIG. 7 is a perspective view of an adapter casing of the antenna assembly of FIG. 1.

FIG. 7 shows the adapter casing 110. The adapter casing 110 includes an insertion portion 710, a casing body 720, and a fastening extension 730. The insertion portion 710 includes a peripheral wall 716 having an outer surface 718, a first locking tab 712 (shown in FIG. 8), and a second locking tab 714. The peripheral wall 716 has an elliptical cross-section in the current embodiment. However, in various embodiments, the peripheral wall 716 may have different cross-sectional shapes, including a circular cross-section, a rectangular or square cross-section, or any other shape, and the disclosure of an elliptical cross-section should not be considered limiting. The peripheral wall 716 includes an open upper end 782 defining an upper opening 784. The upper opening 784 has an elliptical profile in the current embodiment, though the profile of the upper opening 784 may have other shapes in various embodiments and the disclosure of an elliptical profile should not be considered limiting.

The casing body 720 includes a casing top plate 722 and casing side wall 724 extending downwards from the casing top plate 722. The casing top plate 722 also defines an access window 726 therethrough for visual access to identifying information shown on the radio unit 120, though the access window 726 is not present in various embodiments. The peripheral wall 716 extends upward from the casing top plate 722. The casing side wall 724 includes an inner surface 792 and forms a plurality of snap fit arms 728*a,b,c,d,e,f* spaced evenly along the casing side wall 724. There are six snap fit arms 728*a,b,c,d,e,f* in the current embodiment, though any number of snap fit arms 728, including no snap fit arms 728, may be present in various embodiments. The snap fit arms 728*a,b,c,d,e,f* taper in a downward direction from the casing top plate 722, though each of the snap fit arms 728*a,b,c,d,e,f* may not taper in various embodiments or may taper in an upward direction. Each snap fit arm 728*a,b,c,d,e,f* includes a lower end 786*a,b,c,d,e,f* and a snap fit rib 788*a,b,c,d,e,f* (b shown in FIG. 8, c shown in FIG. 17, a,e not shown). The snap fit ribs 788*a,b,c,d,e,f* are formed in the inner surface 792 proximate to the lower ends 786*a,b,c,d,e,f* of each snap fit arms 728*a,b,c,d,e,f*, respectively, and extend inward from the inner surface 792.

In the current embodiment, the fastening extension 730 is extends from the snap fit arm 728*b* of casing side wall 724 of the casing body 720. In various embodiments, the fastening extension 730 is positioned in various locations on the casing body 720 including any of the snap fit arms 728*a,b,c,d,e,f*. In various embodiments, the fastening extension 730 is not present. The fastening extension 730 includes an extension base 732 and a fastening plate 734. The extension base 732 is connected to the snap fit arm 728*b* and the fastening plate 734 extends downward and to one side of the extension base 732. The fastening extension 730 also includes a pair of fastener plugs 736*a,b* extending outward from the fastening plate 734.

Each fastening plug 736*a,b* includes a fastener bore 738*a,b*, respectively, defined therethrough and through the fastening plate 734. The fastener bores 738*a,b* are sized to accept a pair of fasteners (not shown) for connection with the radio unit 120. The radio unit 120 includes a fastening plate 122 (shown in FIG. 1) having a pair of fastener bores 124*a,b*, (shown in FIG. 1) which align with the fastener bores 738*a,b*, respectively, when the adapter casing 110 is installed over the radio unit 120. When the fastener bores 124*a,b*, are aligned with the fastener bores 738*a,b*, a pair of fasteners such as screws or nuts and bolts may be used to connect the fastening plate 122 to the fastening plate 734, connecting the adapter casing 110 to the radio unit 120.

Figure 8:
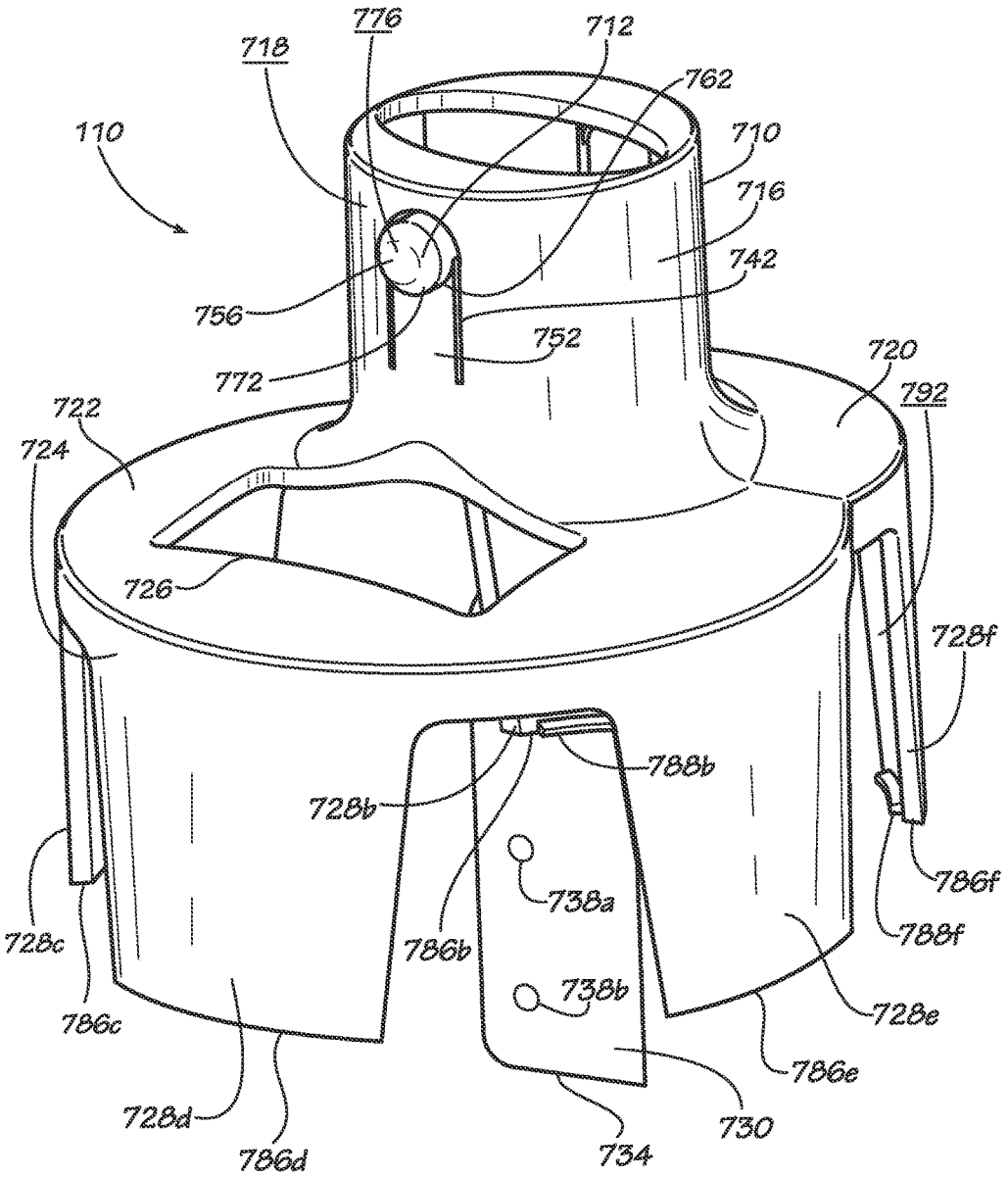
FIG. 8 is another perspective view of the adapter casing of FIG. 7.

FIG. 8 show the first locking tab 712 and FIG. 7 shows the second locking tab 714. The first locking tab 712 is formed by a first slit 742 defined in the peripheral wall 716, and the second locking tab 714 is formed by a second slit 744 defined in the peripheral wall 716. The first slit 742 and the second slit 744 are U-shaped in the current embodiment, though other shapes may be present in various embodiments. The first locking tab 712 and the second locking tab 714 are on opposing sides of peripheral wall 716 in the current embodiment, though the first locking tab 712 and the second locking tab 714 may be located in different locations on the peripheral wall 716 in various embodiments.

The first locking tab 712 includes a first lever portion 752 and a first plug 756, and the second locking tab 714 includes a second lever portion 754 and a second plug 758. The first plug 756 includes a first chamfer 772 and a first plug outer surface 776, and the second plug 758 includes a second chamfer 774 and a second plug outer surface 778. The intersection of the first lever portion 752 and the first plug 756 defines a first groove 762 facing downward towards the casing body 720 and sized to accept the first catch lip 282, and the intersection of the second lever portion 754 and the second plug 758 defines a second groove 764 facing downward towards the casing body 720 and sized to accept the second catch lip 284. The first lever portion 752 and the second lever portion 754 are each connected to the peripheral wall 716 and are bendable between each end of the first slit 742 and the second slit 744, respectively, relative to the peripheral wall 716 to bring the first plug outer surface 776 of the first plug 756 and the second plug outer surface 778 of the second plug 758 inward of the outer surface 718 of the peripheral wall 716.

Figure 9:
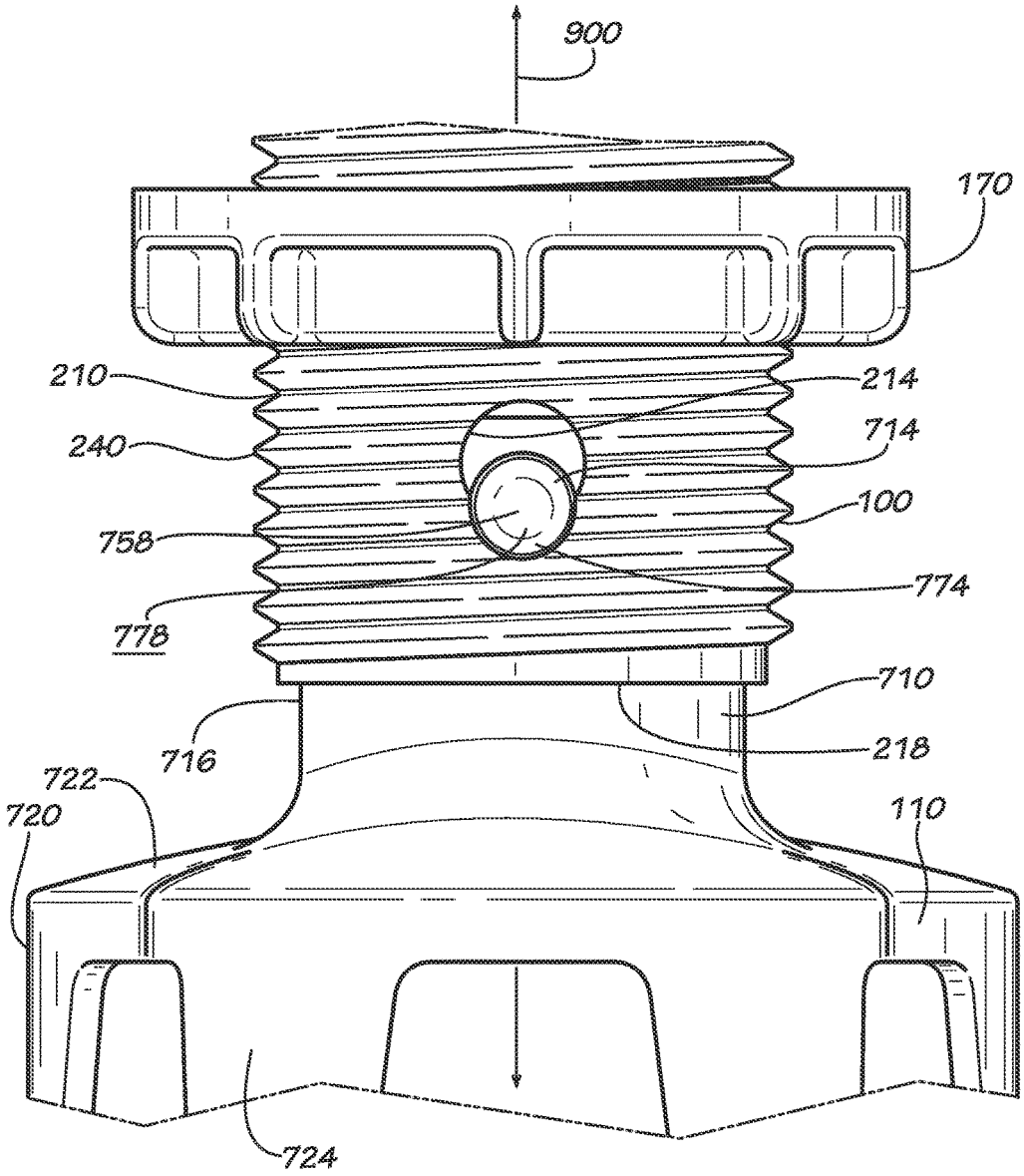
FIG. 9 is a side view of the antenna assembly of FIG. 1 showing the connection between the antenna casing and the adapter casing.

As shown in FIG. 9, the insertion portion 710 of the adapter casing 110 is inserted into the casing wall 210 of the antenna casing 100 in an axial direction 900 defined by the casing wall 210 and the insertion portion 710. The axial direction 900 is collinear with the axis 260 of the casing wall 210 in the current embodiment. The first plug 756 and the second plug 758 are sized to fit within the first connection hole 212 and the second connection hole 214 of the casing wall 210, respectively, to attach the antenna casing 100 to the adapter casing 110. To insert the insertion portion 710 into the adapter casing 110, the first plug 756 and the second plug 758 are first aligned with the first guide slot 512 and the second guide slot 514, respectively. The insertion portion 710 is then inserted in the axial direction 900 into the casing wall 210, and the first plug 756 and the second plug 758 thereby contact the inner chamfer 518 of the casing wall 210, which forces the first plug 756 and the second plug 758 to move inward, bending the first lever portion 752 and the second lever portion 754 inward.

The first plug 756 and the second plug 758 thereby slide upwards along the axial direction 900 into the first guide slot 512 and the second guide slot 514, respectively. The first plug outer surface 776 and the second plug outer surface 778 thereby contact the inner surface 230 of the casing wall 210 within the first guide slot 512 and the second guide slot 514, respectively, and slide upwards along the axial direction 900 within the first guide slot 512 and the second guide slot 514, respectively, towards the first connection hole 212 and the second connection hole 214, respectively. The first lever portion 752 and the second lever portion 754 bias the first plug 756 and the second plug 758, respectively, against the inner surface 230. The first guide slot 512 and the second guide slot 514 thereby act to guide the first plug 756 of the first locking tab 712 and the second plug 758 of the second locking tab 714 towards the first connection hole 212 and the second connection hole 214, respectively.

When the first plug 756 and the second plug 758 reach the first connection hole 212 and the second connection hole 214, respectively, the first plug outer surface 776 and the second plug outer surface 778 clear the first guide slot 512 and the second guide slot 514, respectively, and first lever portion 752 and the second lever portion 754 push outward on the first plug 756 and the second plug 758, respectively, because the first lever portion 752 and the second lever portion 754 are flexed inward and exert an outward force on the first plug 756 and the second plug 758, respectively. The first plug 756 and the second plug 758 then enter into the first connection hole 212 and the second connection hole 214, respectively, "snapping" into the first connection hole 212 and the second connection hole 214, respectively. Once the first plug 756 and the second plug 758 enter the first connection hole 212 and the second connection hole 214, the adapter casing 110 may then be moved downward along the axial direction 900 relative to the antenna casing 100, which engages the first catch lip 282 with the first groove 762 of the first plug 756 and engages the second catch lip 284 with the second groove 764 of the second plug 758. This engagement holds the first locking tab 712 and the second locking tab 714 in place, attaching the adapter casing 110 to the antenna casing 100 and preventing accidental separation of the antenna casing 100 from the adapter casing 110.

To disconnect the adapter casing 110 from the antenna casing 100 in the current embodiment, the adapter casing 110 must be moved upward along the axial direction 900 to disengage the first groove 762 and the second groove 764 from the first catch lip 282 and the second catch lip 284, respectively. The first plug 756 and the second plug 758 may thereafter be pushed inward to an inward position such that the first plug 756 and the second plug 758 are removed from the first connection hole 212 and the second connection hole 214. While holding the first plug 756 and the second plug 758 in an inward position, the insertion portion 710 of the adapter casing 110 may then be removed from the casing wall 210 of the antenna casing 100 by moving the antenna casing 100 apart from the adapter casing 110 along the axial direction 900. The first plug 756 and the second plug 758 thereby slide downwards in the first guide slot 512 and the second guide slot 514, respectively, until the first plug 756 and the second plug 758 are clear of the bottom edge 218 of the casing wall 210.

The first chamfer 772 of the first plug 756 and the second chamfer 774 of the second plug 758 assist in moving the first plug 756 and the second plug 758 into the first guide slot 512 and the second guide slot 514, respectively, both during insertion of the insertion portion 710 into the casing wall 210 and during removal of the insertion portion 710 from within the casing wall 210.

Figure 10:
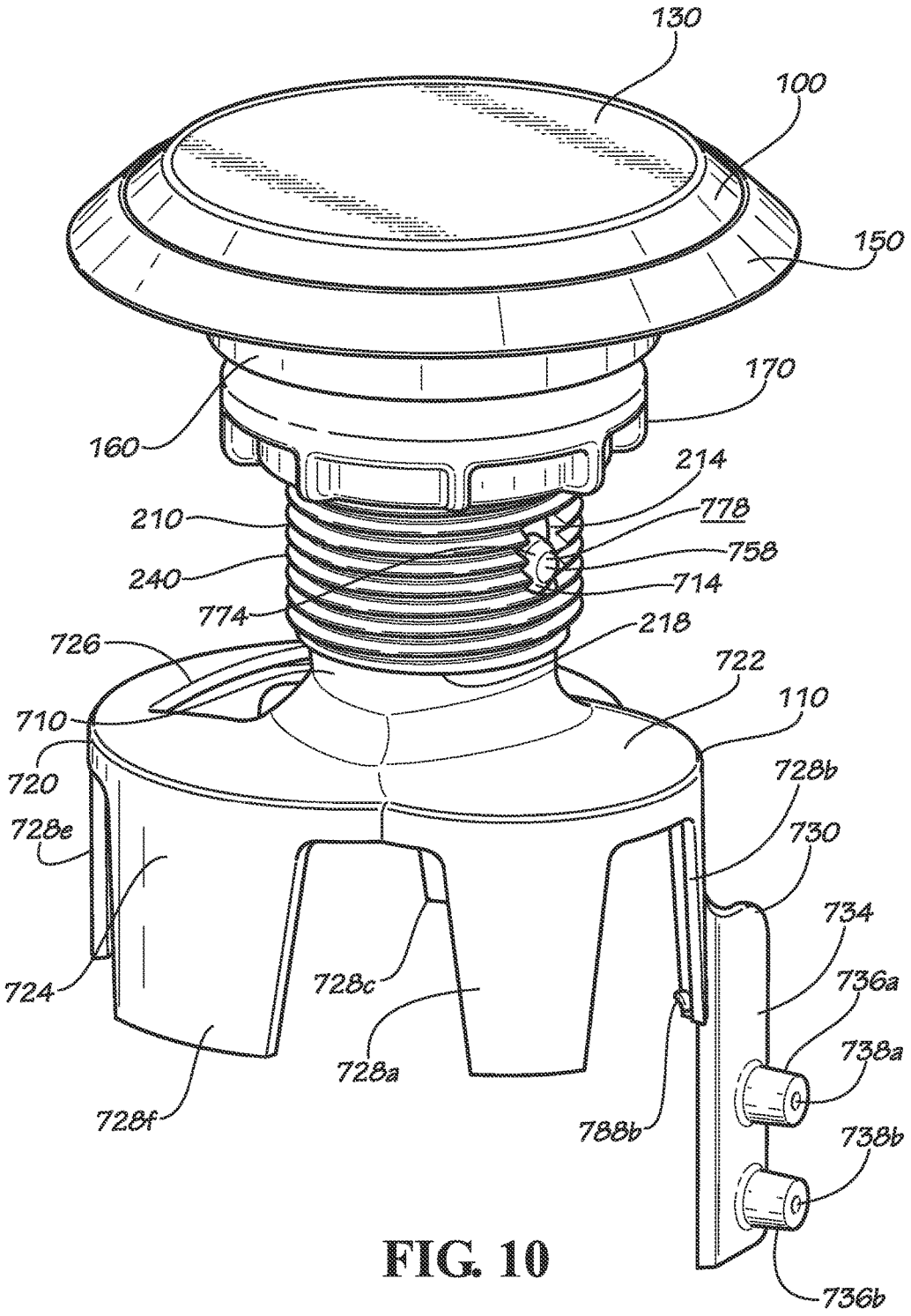
FIG. 10 is a perspective view of the antenna assembly of FIG. 1 prior to attachment of the adapter casing to a radio unit.

FIG. 10 shows a perspective view of the antenna casing 100 attached to the adapter casing 110. FIG. 10 shows the second plug 758 positioned within the second connection hole 214 with the first groove 762 engaged with the first catch lip 282.

Figure 11:
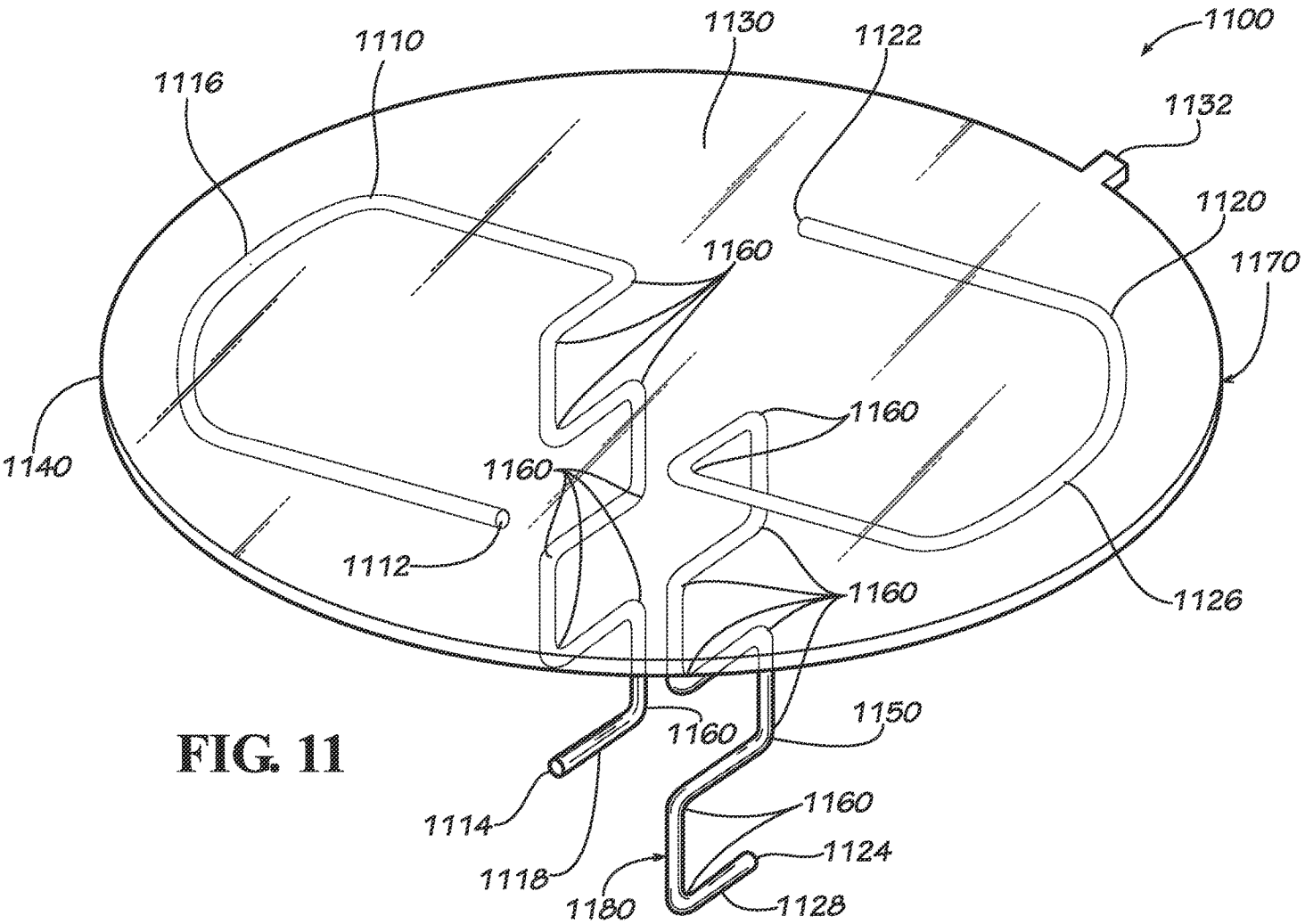
FIG. 11 is a perspective view of an antenna of the antenna assembly of FIG. 1.

FIG. 11 shows a perspective view of an antenna 1100. The antenna 1100 includes a first antenna wire 1110, a second antenna wire 1120, and a laminated disc 1130. The first antenna wire 1110 and the second antenna wire 1120 are each copper wires in the current embodiment, though other materials may be present in various embodiments. The first antenna wire 1110 includes a first upper end 1112 and a first lower end 1114. The second antenna wire 1120 includes a second upper end 1122 and a second lower end 1124. The first antenna wire 1110 also includes a first radiant element 1116 and a first coupling coil 1118. The second antenna wire 1120 also includes a second radiant element 1126 and a second coupling coil 1128. The first radiant element 1116 and the second radiant element 1126 are U-shaped in the current embodiment, though various shapes may be present in various embodiments. The U-shapes of the first radiant element 1116 and the second radiant element 1126 are oriented in a horizontal plane facing opposite directions in the current embodiment, though different orientations may be present in various embodiments. The first coupling coil 1118 and the second coupling coil 1128 are formed by a plurality of 90° bends 1160 in the first antenna wire 1110 and the second antenna wire 1120, respectively, orienting the first coupling coil 1118 and the second coupling coil 1128 in parallel vertical planes extending transverse to the horizontal plane defined by the first radiant element 1116 and the second radiant element 1126. The 90° bends 1160 form a plurality of alternating horizontal and vertical portions in the first coupling coil 1118 and the second coupling coil 1128.

The laminated disc 1130 is a clear polyester film in the current embodiment, though various materials, either clear or opaque, such as polyimide, are present in various embodiments. Laminated disc 1130 is circular in the current embodiment, though the laminated disc 1130 includes different shapes in various embodiments, such as a square, rectangle, ellipse, or triangle, and the disclosure of a circular disc should not be considered limiting. The laminated disc 1130 encloses the first radiant element 1116 and the second radiant element 1126, thereby extending in the same horizontal plane as the first radiant element 1116 and the second radiant element 1126 in the current embodiment. The laminated disc 1130 also includes a tab 1132 in the current embodiment which may assist in lifting the laminated disc 1130 off of the top surface 222.

The laminated disc 1130, the first radiant element 1116 of the first antenna wire 1110, and the second radiant element 1126 of the second antenna wire 1120 are located in an upper section 1170 of the antenna 1100. The first coupling coil 1118 of the first antenna wire 1110 and the second coupling coil 1128 of the second antenna wire 1120 are located in a lower section 1180 of the antenna 1100.

Figure 12:
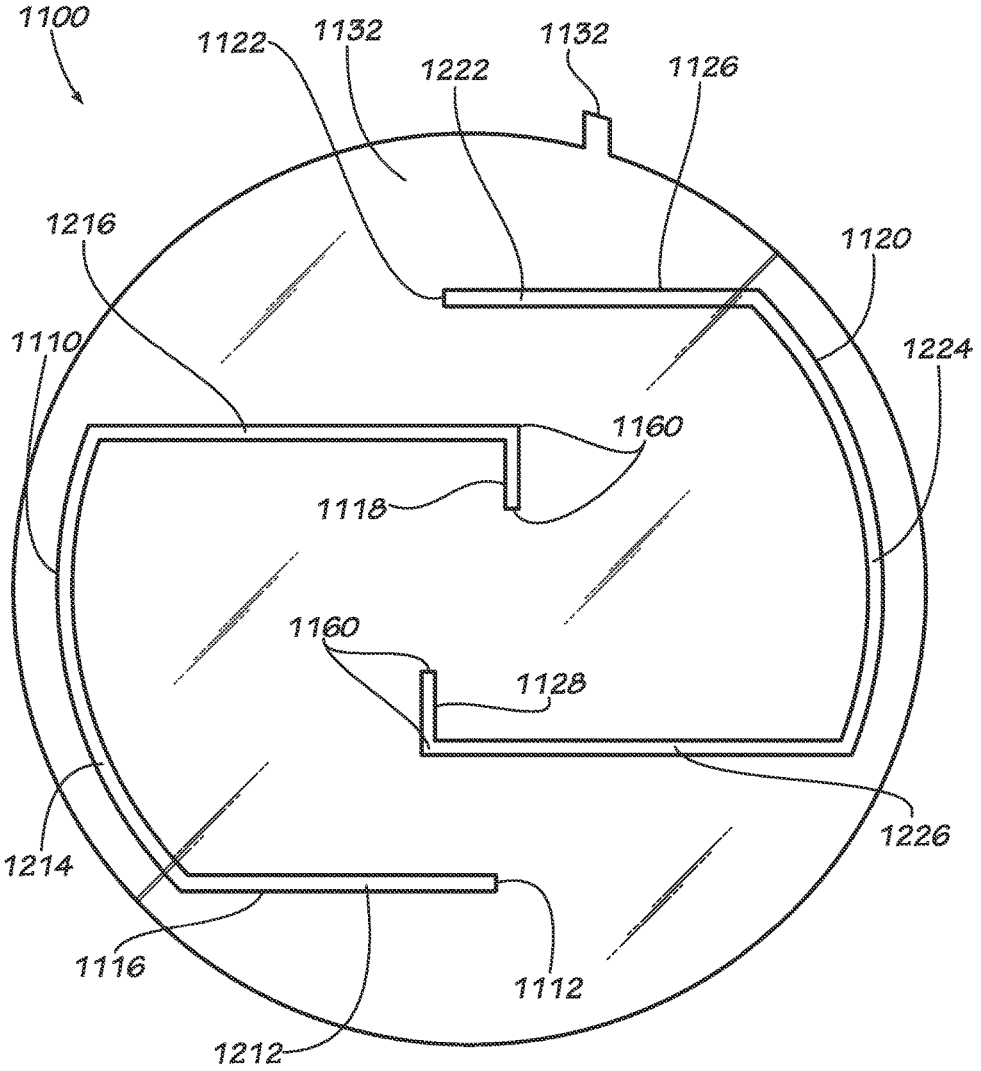
FIG. 12 is a top view of the antenna of FIG. 11.

FIG. 12 shows a top view of the antenna 1100, showing the upper section 1170 of the antenna 1100. As shown in FIG. 12, the first radiant element 1116 includes a first end leg 1212 extending from the first upper end 1112, a first transition leg 1216 extending from the first coupling coil 1118, and a first curved portion 1214 extending from the first end leg 1212 to the first transition leg 1216. The second radiant element 1126 includes a second end leg 1222 extending from the second upper end 1122, a second transition leg 1226 extending from the second coupling coil 1128, and a second curved portion 1224 extending from the second end leg 1222 to the second transition leg 1226.

Figure 13:
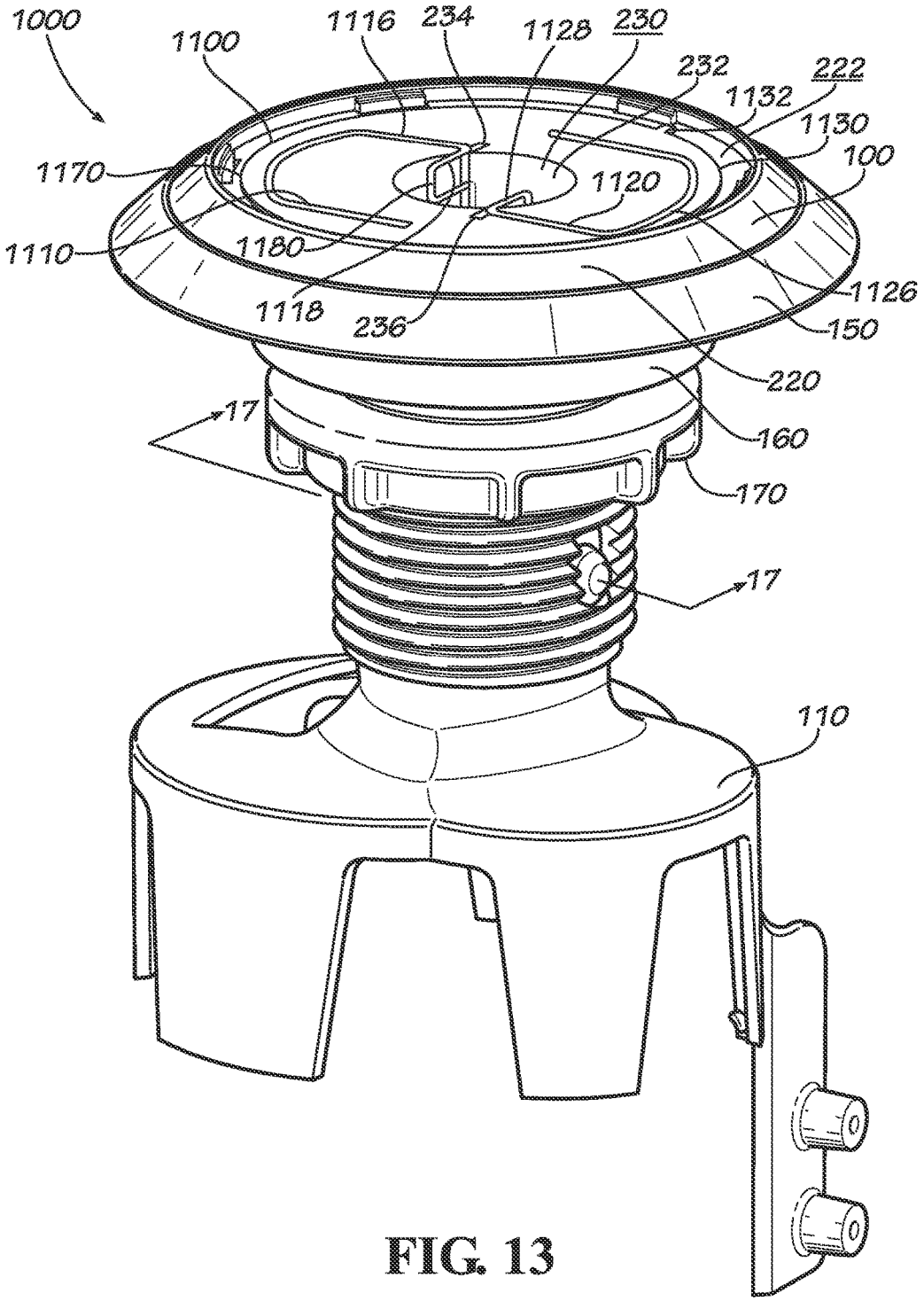
FIG. 13 is a perspective view of the antenna assembly of FIG. 1 with a top cap of the antenna assembly removed and prior to attachment of the adapter casing to the radio unit.

FIG. 13 shows a perspective view of the antenna assembly 1000 with the top cap 130 removed and prior to attachment of the radio unit 120. As shown in FIG. 13, the antenna 1100 is placed within the antenna casing 100. To place the antenna 1100 within the antenna casing 100, the lower section 1180 of the antenna 1100 is inserted into cavity defined by the inner surface 230 of the casing wall 210, into the upper cylindrical section 232 of the casing wall 210, with a portion of the first coupling coil 1118 placed in the first antenna slot 234 and with a portion of the second coupling coil 1128 placed in the second antenna slot 236. The first antenna slot 234 is sized to accept a portion of the first coupling coil 1118 and the second antenna slot 236 is sized to accept a portion of the second coupling coil 1128. The first antenna slot 234 and the second antenna slot 236 thereby prevent rotation of the antenna 1100 within the antenna casing 100. When the lower section 1180 of the antenna 1100 is inserted into the upper cylindrical section 232 of the casing wall 210, the upper section 1170 of the antenna 1100 comes into contact with, and thereby rests upon, the top surface 222 of the mushroom head 220.

Figure 14:
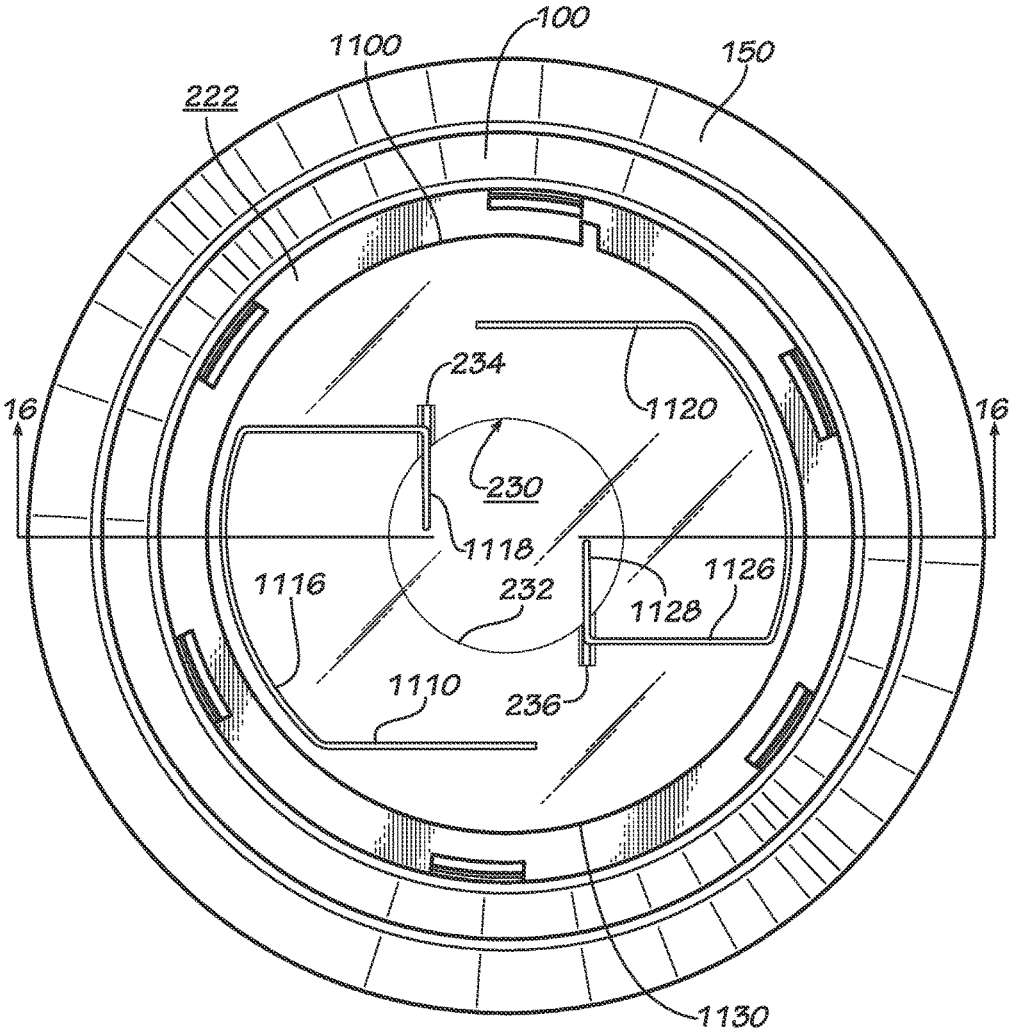
FIG. 14 is a top view of the antenna of FIG. 11 inserted into the antenna casing of FIG. 2.

FIG. 14 shows a top view of the antenna casing 100, antenna 1100, and upper washer 150. As shown in FIG. 14, in the current embodiment, only a partial portion of the first coupling coil 1118 and a partial portion of the second coupling coil 1128 are placed in the first antenna slot 234 and the second antenna slot 236, respectively, though in various embodiments different portions of the first coupling coil 1118 and different portions of the second coupling coil 1128, including the entirety of each or no portion of each or a portion of one and no portion of the other, are placed in the first antenna slot 234 and the second antenna slot 236 in various embodiments.

Figure 15:
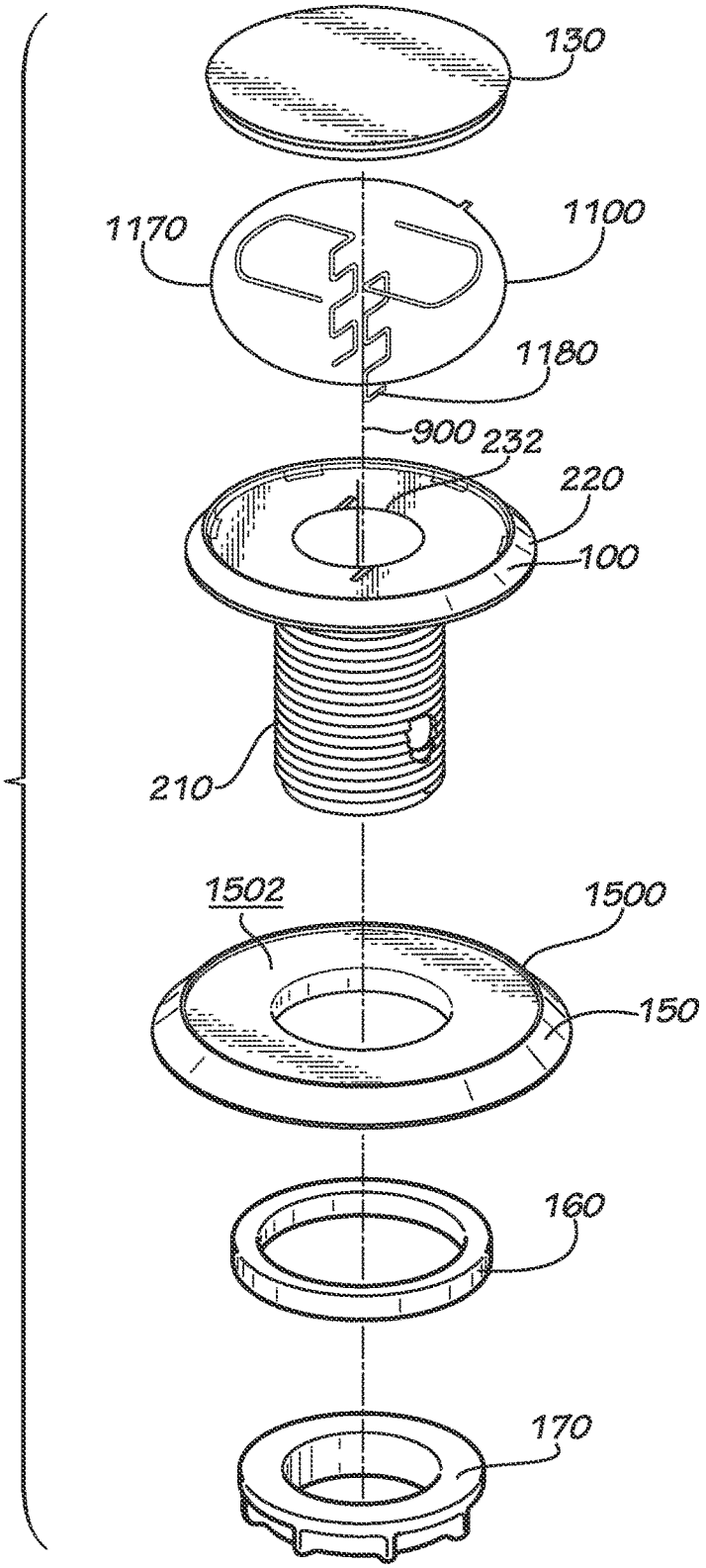
FIG. 15 is an exploded perspective view of the top cap, antenna, antenna casing, upper washer, lower washer, and nut of the antenna assembly of FIG. 1.

FIG. 15 shows an exploded perspective view of the top cap 130, the antenna 1100, the antenna casing 100, the upper washer 150, the lower washer 160, and the nut 170. As shown in FIG. 15, the antenna 1100 is placed into the cylindrical section 232 of the antenna casing 100 by moving the antenna 1100 along the axial direction 900 defined through casing wall 210 of the antenna casing 100. Further, as shown in FIG. 15, the upper washer 150 includes a peripheral upper lip 1500 and a top surface 1502 in the current embodiment. When the antenna casing 100 is placed on the upper washer 150, the mushroom head 220 is sized to fit within the peripheral upper lip 1500 of the upper washer 150 and rest on the top surface 1502.

Figure 16:
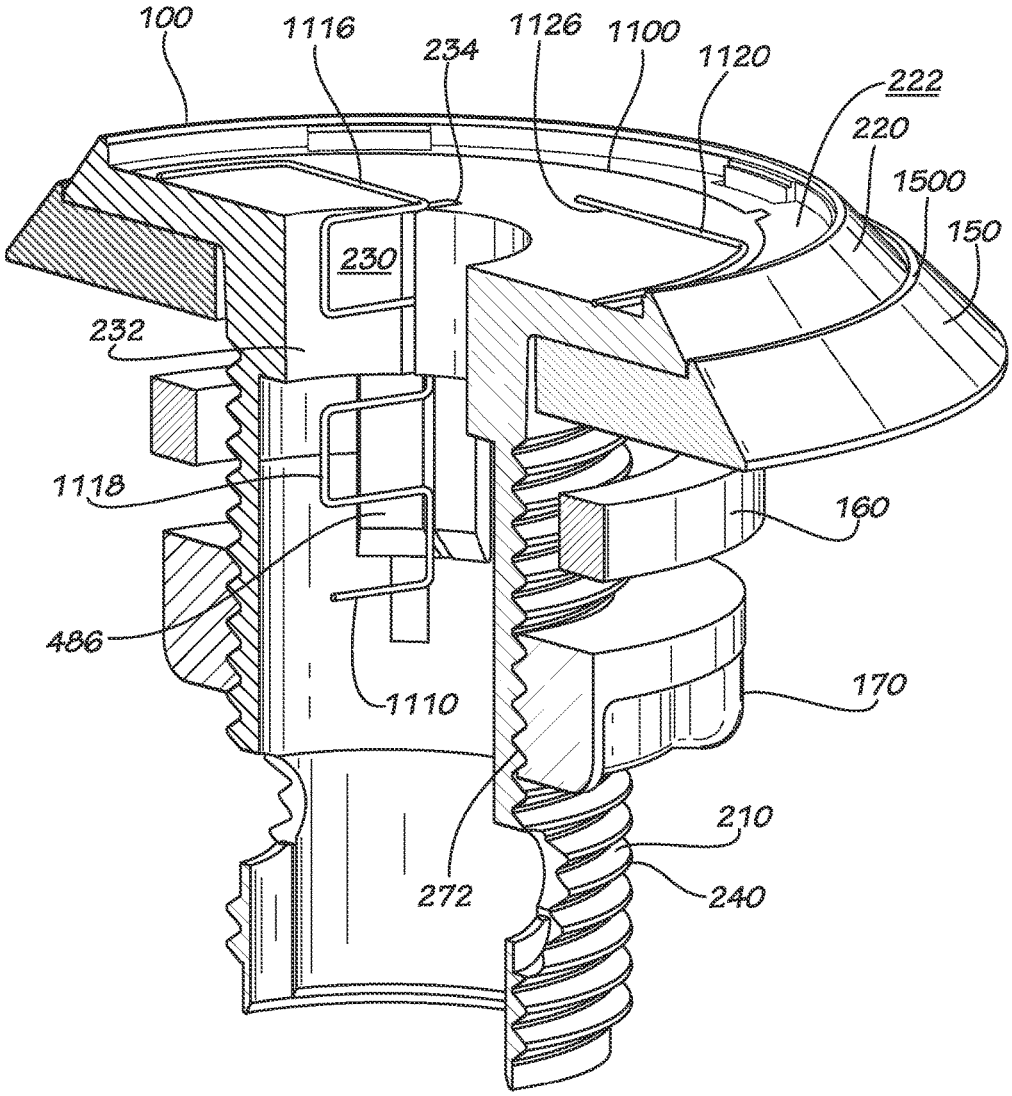
FIG. 16 is a cross-sectional perspective view of the antenna casing, antenna, upper washer, lower washer, and nut of the antenna assembly of FIG. 1 taken along line 16-16 in FIG. 14.

FIG. 16 shows a perspective cross-sectional view of the antenna 1100, antenna casing 100, upper washer 150, lower washer 160, and nut 170 taken along line 16-16 in FIG. 14. As shown in FIG. 16, a portion of the first coupling coil 1118 is placed in the first antenna slot 234. However, in the current embodiment, no portion of the first coupling coil 1118 is placed within the first antenna slot 234 in the first minor shoulder 486. Likewise, in the current embodiment, no portion of the second coupling coil 1128 is placed within the second antenna slot 236 in the current embodiment. In the current embodiment, the portion of the first coupling coil 1118 is only placed within the portion of the first antenna slot 234 in the upper cylindrical section 232, and the portion of the second coupling coil 1128 is only placed within the portion of the second antenna slot 236 in the upper cylindrical section 232.

Figure 17:
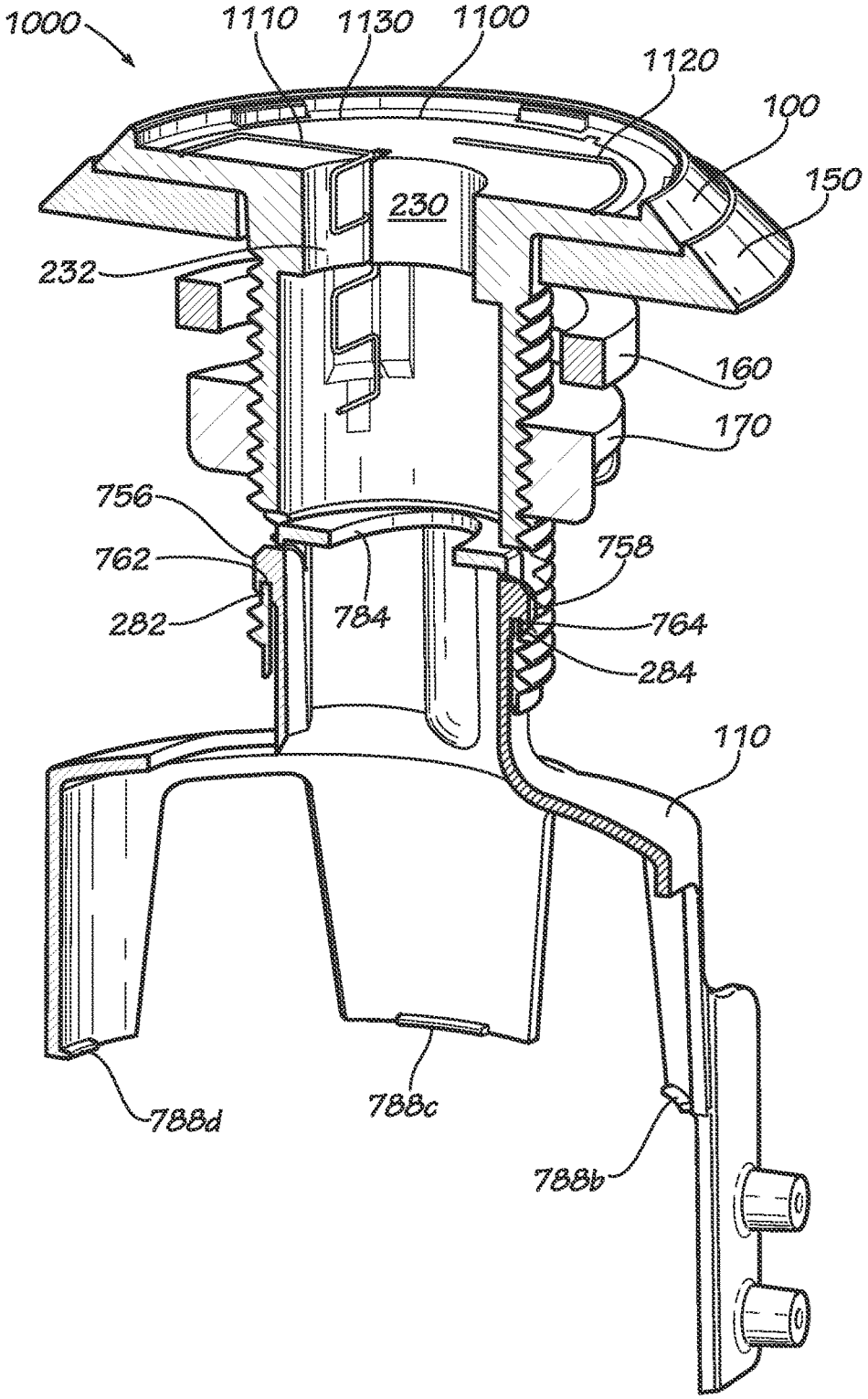
FIG. 17 is a cross-sectional perspective view of the antenna assembly of FIG. 1, taken along line 17-17 in FIG. 13, with the top cap removed and prior to attachment of the adapter casing to the radio unit.

FIG. 17 is perspective cross-sectional view of the antenna assembly 1000 with the top cap 130 and the radio unit 120 removed, taken along line 17-17 in FIG. 13. FIG. 17 shows the engagement of the first catch lip 282 with the first groove 762 and the second catch lip 284 with the second groove 764, thereby showing the connection of the adapter casing 110 to the antenna casing 100.

Figure 18:
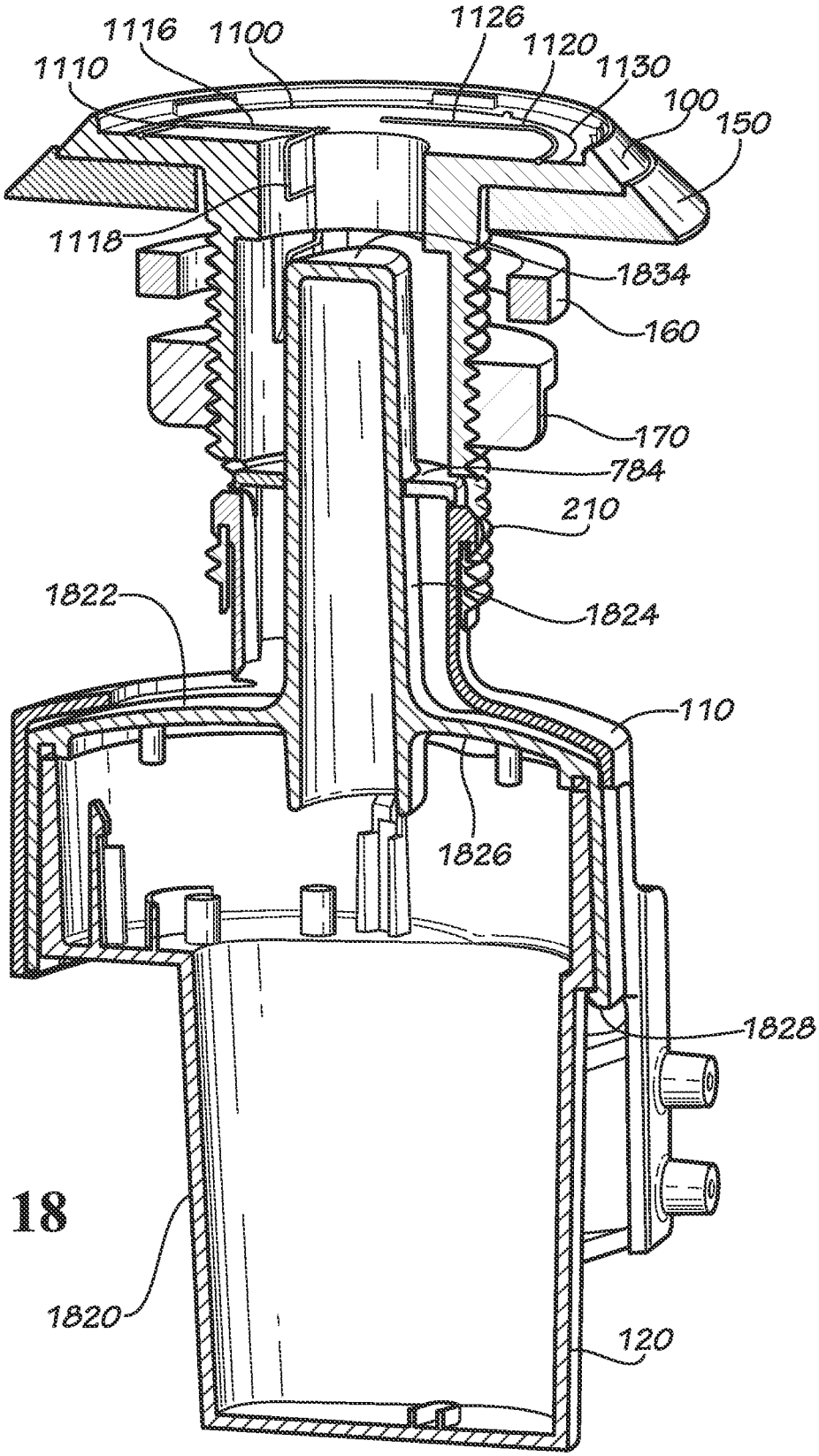
FIG. 18 is a cross-sectional perspective view of the antenna assembly of FIG. 1 with the top cap removed and installed on a radio node taken along line 18-18 in FIG. 1.

FIG. 18 is a perspective cross-sectional view of the antenna assembly 1000 with the top cap 130 removed, taken along line 18-18 in FIG. 1. The internal components of the radio unit 120, including the radio antenna, have been removed for clarity. As shown in FIG. 18, the radio unit 120 includes an upper radio housing 1822 attached to a lower radio housing 1820 by a snap fitting, though other attachment mechanisms such as fasteners are present in various embodiments. The upper radio housing 1822 includes a radio antenna housing extension 1824 extending upward from an upper radio housing base 1826 of the upper radio housing 1822. The radio antenna housing extension 1824 contains the radio antenna. The upper radio housing base 1826 includes a lower edge 1828 around the periphery of the upper radio housing base 1826. To attach the adapter casing 110 to the radio unit 120, the radio unit 120 is inserted upward into the adapter casing 110 until the snap fit ribs 788*a,b,c,d,e,f* of the snap fit arms 728*a,b,c,d,e,f* engage and retain the lower edge 1828, holding the radio unit 120 against the adapter casing 110 by a snap fit. A pair of fasteners such as nuts and bolts may thereafter be used to connect the adapter casing 110 to the radio unit 120 by inserting the fasteners into the pair of fastener plugs 736*a,b* of the fastening plate 734 of the adapter casing 110 and into the fastener bores 124*a,b*, of the fastening plate 122 of the radio unit 120.

Upon insertion of the radio unit 120 into the adapter casing 110, the radio antenna housing extension 1824 is inserted through the upper opening 784 of the adapter casing 110 into the casing wall 210 of the antenna casing 100. An upper end 1834 of the radio antenna housing extension 1824 is thereby placed adjacent to the antenna 1100, with the first coupling coil 1118 and the second coupling coil 1128 positioned on opposite sides of the radio antenna housing extension 1824. The radio antenna may thereafter be inductively coupled to the antenna 1100 through the first coupling coil 1118 and the second coupling coil 1128.

In the current embodiment, the radio unit 120 is a Mueller Mi.Node radio module (DCOM3), though other radio units 120 are present in various embodiments and the present disclosure should not be limited to the Mueller Mi.Node radio module. When the radio unit 120 broadcasts signal through the radio antenna, the signal may be blocked by the pit lid 600 of a meter pit or another barrier. The antenna assembly 1000 acts to extend the transmission beyond the barrier by inductively coupling the antenna 1100 to the radio antenna. When the radio unit 120 is placed in the adapter casing 110 connected to the antenna casing 100, the first coupling coil 1118 and the second coupling coil 1128 couple into the "outer edge" of the reactive section of the near-field or near the area were the reactive field turns into radiative field in the near-field, typically between 2.8" and 4.5" from near-field origin on the Mi.Node radio module (DCOM3) operating industrial, scientific and medical ("ISM") 900 MHz band, though other ranges may be present in various embodiments for different radio modules or for the Mi.Node radio module (DCOM3). The signal is then transmitted from the first radiant element 1116 and the second radiant element 1126 on the other side of the pit lid 600 or other barrier. In the current embodiment, the flat configuration of the first radiant element 1116 and the second radiant element 1126 create an omnidirectional and vertically-polarized signal pattern.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A pit lid antenna assembly comprising:

an antenna having an upper section and a lower section, the lower section extending downwards from the upper section; and an antenna casing having a casing wall, the casing wall having an inner surface, the inner surface defining an upper circumferential shoulder and a first antenna slot, the upper circumferential shoulder defining a top surface and a bottom surface, the top surface disposed opposite from the bottom surface, the first antenna slot extending vertically through the upper circumferential shoulder from the top surface to the bottom surface, the first antenna slot sized to accept a vertical portion of the lower section of the antenna.

2. The assembly of claim 1, wherein the antenna includes a first antenna wire and a second antenna wire, and wherein the first antenna slot is sized to accept a portion of the first antenna wire in the lower section of the antenna.

3. The assembly of claim 2, wherein the inner surface of the casing wall of the antenna casing further defines a second antenna slot, the second antenna slot sized to accept a portion of the second antenna wire in the lower section of the antenna.

4. The assembly of claim 3, wherein the second antenna slot defines a plane parallel to a plane defined by the first antenna slot.

5. The assembly of claim 1, wherein the inner surface includes a cylindrical section, the cylindrical section defining a bore axis, the first antenna slot defined into the casing wall radially outward from the cylindrical section relative to the bore axis.

6. The assembly of claim 1, wherein the antenna casing includes the top surface, the upper section of the antenna contacting the top surface when the first antenna slot accepts a portion of the lower section of the antenna.

7. The assembly of claim 1, further comprising an adapter casing attached to the antenna casing.

8. The assembly of claim 7, wherein:

the antenna casing includes a first connection hole and a second connection hole defined in the casing wall, a first guide slot extending from the first connection hole to a bottom edge of the casing wall, and a second guide slot extending from the second connection hole to the bottom edge of the casing wall;

the adapter casing includes a first locking tab and a second locking tab, each of the first locking tab and the second locking tab having a plug sized to fit within the first connection hole and the second connection hole; and wherein the first guide slot is sized to guide the first locking tab to the first connection hole and the second guide slot is sized to guide the second locking tab to the second connection hole to attach the adapter casing to the antenna casing.

9. The assembly of claim 7, further comprising a radio unit, the radio unit including a radio housing and a radio antenna contained within the radio housing, the radio housing attached to the adapter casing, the adapter casing coupling the radio unit to the antenna casing, the radio antenna inductively coupled to the antenna.

10. A pit lid antenna assembly comprising:

an antenna;

an antenna casing, the antenna casing housing the antenna and having a casing wall defining a bore with a center axis, the casing wall defining an inner surface and an outer surface, the casing wall defining a connection hole extending through the casing wall from the outer surface to the inner surface, the connection hole defining an axis perpendicular to the center axis, the connection hole defining a center, a guide slot defined by the casing wall extending axially downward parallel to the center axis of the bore from the connection hole to a bottom edge of the casing wall, the casing wall defining a catch lip located below the connection hole; and an adapter casing attached to the antenna casing and including a locking tab, the locking tab having a plug sized to fit within the connection hole to attach the adapter casing to the antenna casing, the plug defining a first portion and a second portion, the first portion attached to the locking tab, the second portion extending through the connection hole and disposed external to the casing wall, a groove defined extending into the plug between the first portion and the second portion, the groove engaging the catch lip.

11. The assembly of claim 10, wherein the guide slot is sized to guide the locking tab to the connection hole to attach the adapter casing to the antenna casing.

12. The assembly of claim 10, wherein the antenna casing includes a second connection hole defined in the casing wall and wherein the adapter casing includes a second locking tab, the second locking tab having a plug sized to fit within the second connection hole to attach the adapter casing to the antenna casing.

13. The assembly of claim 10, further comprising a radio unit, the radio unit including a radio housing and a radio antenna contained within the radio housing, the radio housing attached to the adapter casing, the adapter casing coupling the radio unit to the antenna casing, the radio antenna inductively coupled to the antenna.

14. The assembly of claim 13, wherein the radio housing attaches to the adapter casing with a snap fit.

15. The assembly of claim 10, wherein an intersection of the connection hole and the inner surface defines an inner connection hole edge, and wherein the guide slot intersects the inner connection hole edge.

16. The assembly of claim 10, wherein the plug is disposed on a bendable lever portion of the locking tab, and wherein the plug is configured to engage the connection hole by moving radially outward relative to the center axis.

17. The assembly of claim 10, wherein engagement between the catch lip and the groove is configured to prevent withdrawal of the plug from the connection hole.

18. A method of installing an antenna assembly in a meter pit comprising:

mounting an antenna casing onto a pit lid, the antenna casing housing an antenna and including a casing wall defining a bore with a center axis, the casing wall defining an inner surface and an outer surface, the casing wall extending below the pit lid and defining a connection hole, the connection hole extending through the casing wall from the outer surface to the inner surface, the connection hole defining an axis perpendicular to the center axis, the casing wall defining a catch lip below the connection hole;

attaching a radio unit to an adapter casing, the adapter casing including a locking tab, the locking tab having a plug, the plug defining a groove;

attaching the adapter casing to the antenna casing by linearly stabbing an insertion portion of the adapter casing into the antenna casing thereby snapping the plug of the locking tab into the connection hole; and securing the plug within the connection hole and preventing withdrawal of the plug from the connection hole by engaging the catch lip with the groove, wherein engaging the catch lip with the groove comprises moving the adapter casing axially downward parallel to the center axis of the bore from the antenna casing until the groove receives the catch lip.

19. The method of claim 18, wherein the antenna casing includes a guide slot extending axially parallel to the center axis of the bore from a center of the connection hole to a bottom edge of the casing wall, and wherein attaching the adapter casing to the antenna casing includes sliding the locking tab in the guide slot towards the connection hole.

20. The method of claim 18, wherein:

the antenna includes an upper section and a lower section;

the casing wall has an inner surface, the inner surface defining a first antenna slot; and a portion of the lower section of the antenna is positioned within the first antenna slot.

21. The method of claim 18, wherein the casing wall includes an inner surface having a cylindrical section defining an axis, and wherein attaching the adapter casing to the antenna casing includes moving the adapter casing towards the antenna casing in a direction parallel to the axis of the cylindrical section.

22. The method of claim 18, wherein the casing wall includes an inner surface defining a cavity, and wherein attaching the adapter casing to the antenna casing includes inserting a portion of the adapter casing into the cavity of the antenna casing.

23. The method of claim 18, wherein the antenna includes a first antenna wire and a second antenna wire, the method further comprising inductively coupling the first antenna wire and the second antenna wire to the radio unit.

24. The method of claim 18, wherein attaching the adapter casing to the antenna casing comprises:

bending the locking tab radially inward relative to the center axis about a lever portion of the locking tab, and bending the locking tab radially outward relative to the center axis about the lever portion of the locking tab to engage the plug with the connection hole.

* * * * *